United States Patent [19]

Reuter et al.

[11] 4,022,925

[45] May 10, 1977

[54] PROCESS FOR COATING METAL SURFACES WITH SYNTHETIC RESINS

[75] Inventors: Franz Gottfried Reuter, Lemfoerde; Peter Holl, Tubingen, both of Germany

[73] Assignee: Polymer-Physik GmbH & Co. KG, Germany

[22] Filed: June 6, 1975

[21] Appl. No.: 584,291

[30] Foreign Application Priority Data

July 20, 1974 Germany ..... 2435061

[52] U.S. Cl. ..... 427/35; 427/44; 427/327

[51] Int. Cl.[2] ..... B05D 3/06

[58] Field of Search ..... 427/35, 39, 41, 331, 427/350, 409, 44, 302, 327

[56] References Cited

UNITED STATES PATENTS

| | | | |
|---|---|---|---|
| 2,929,744 | 3/1960 | Mathes et al. | 427/44 |
| 2,989,633 | 6/1961 | Wilson | 427/44 |
| 3,374,111 | 3/1968 | Brennemann | 427/44 |
| 3,418,155 | 12/1968 | Colvin et al. | 427/35 |
| 3,619,242 | 11/1971 | Ogawa et al. | 427/41 |
| 3,632,386 | 1/1972 | Hurst | 427/41 |
| 3,681,103 | 8/1972 | Brown | 427/44 |

*Primary Examiner*—Cameron K. Weiffenbach
*Attorney, Agent, or Firm*—McGlew and Tuttle

[57] ABSTRACT

A process is provided for coating metal surfaces with synthetic resins in which, prior to application of synthetic resin, said metal surfaces are irradiated with high energy rays in presence of at least one organic compound and/or cf at least one organosilicon-oxygen compound (silicones) and only then is the metal surface coated with synthetic resin in the usual manner.

9 Claims, 1 Drawing Figure

PROCESS FOR COATING METAL SURFACES WITH SYNTHETIC RESINS

FIELD AND BACKGROUND OF THE INVENTION

The present invention relates to a process for coating of metal surfaces with synthetic resins, in which the metal surfaces are subjected to a special pre-treatment by high energy rays before applying the synthetic resin.

DESCRIPTION OF THE PRIOR ART

It is known that in vapour deposition processes, for example, an extremely thin layer of metal is vapor-deposited on a substrate in vacuo; In such processes, the surface of the substrate is bombarded, before the vapor deposition, with ions and electrons from a gas discharge (that is to say, exposed to a glow discharge) or exposed to pure electron bombardment in vacuo, in order to improve the adhesion of the material being vapor-deposited. For example, the vapor-deposited metal or a vapor-deposited layer of a dielectric adheres substantially better to a surface pretreated in this way than without such pre-treatment.

Further, it is known that in coating metal sheets with synthetic resins, the problem of how to improve the adhesion of the synthetic resins to the surfaces of the metal sheets constantly recurs. In order to solve this problem work has been carried out in particular to improve the lacquers, or the plastic powder compositions, themselves. Of course, endeavours have also been made to achieve an improvement in the adhesion of the synthetic resins to the metal surfaces by subjecting the metal surfaces to a chemical and/or mechanical pre-treatment. Approaches known in this field are, for example, cleaning with trichloraethylene, and phosphatising of chromatising the metal surfaces by dipping the metal articles into appropriate baths, with subsequent rinsing. However, these baths entail considerable effort. In particular, their consumption of rinsing water, and the effluent contamination resulting therefrom, represent a major pollution of the environment. For example, the coating of metal surfaces with synthetic resin powders, in which no solvents are required, would be very advantageous from an environmental point of view if the objectionable pre-treatment stages in the various baths were not necessary.

OBJECT OF THE INVENTION

It is, therefore, an object of the present invention to develop a process for coating metal surfaces with synthetic resin, in which (1) the synthetic resin adheres at least as well as in the case of the conventional coating processes; (2) the metal surface has been subjected to a chemical and/or mechanical pre-treatment, and (3) (new process) the expensive chemical and/or mechanical pre-treatments are replaced by a simple, clean pre-treatment which does not pollute the environment.

SUMMARY OF THE INVENTION

This and other objects have been achieved by exposing the metal surfaces, prior to their coating with synthetic resin, to high energy radiation, such as, for example, an electron beam and/or an ion beam, in the presence of an organic substance and/or of an organosilicon-oxygen compound (e.g., a silicone) which is present on the metal surface in the form of a thin film or is in contact, in the form of a gas, with the metal surface.

In fact it has been found, surprisingly, that substantially better adhesion of the synthetic resin to the metal surface is achieved if the metal surface is exposed to the high energy radiation in the presence of organic substances and/or organosilicon-oxygen compounds. Evidently, this produces a contamination layer which can consist, for example, of hydrocarbon molecules, and which adheres very firmly to the metal surface. Detaching this layer by means of the customary chemical agents is virtually impossible. Mechanical methods have to be employed for this purpose.

DESCRIPTION OF THE PREFERRED EMBODIMENTS

Accordingly, the subject of the invention is a process for coating metal surfaces with synthetic resins, which is characterised in that the metal surfaces to be coated are irradiated, before application of the synthetic resin, with high energy rays in the presence of organic compounds and/or organosilicon-oxygen compounds and are only then coated with synthetic resin in the usual manner.

The process according to the invention is particularly valuable for the coating of cold-rolled metal sheets which are coated with a very thin layer of oil, for example, a layer of mineral oil, by the metal sheet manufacturer, to provide temporary corrosion protection. In most cases, a deep-drawing oil is used for this purpose to facilitate the sliding action of the tool during subsequent shaping. When using the process according to the invention, these metal sheets are merely cleaned mechanically to remove dust or other contaminations and are, for example, bombarded with an electron beam and/or ion beam in air at a dose of between 5 and 20 MRad. Thereafter, the metal sheets are coated directly, in the hitherto customary manner, with "powder lacquer" or a lacquer containing solvent, or a lacquer consisting of a polymer-monomer mixture. Measurements of the adhesion by means of the Erichsen deep-drawing test, the falling ball test, the mandrel bending test and the cross-cut test give better results than in the case of the conventionally pre-treated metal sheets which, prior to the coating process, were "degreased" in a trichloroethylene bath and were then phosphatised or chromatised. As a result of the fact that in the process according to the invention the "degreasing stage" and the other bath stages are omitted, a further great contribution to environmental protection is made, since the use and monitoring of trichloroethylene baths, appropriate phosphatising or chromatising baths, and rinsing baths is no longer necessary and as a result, of course, the question of disposal or working up of the oil-saturated trichloroethylene also does not arise.

The radiation sources employed according to the invention to generate high energy radiation, especially electron accelerators, are commercially available in a great variety of embodiments. Their incorporation into existing coating lines is simple, apart from the screening devices which may at times be necessary. The operating costs and maintenance costs are low. The process is preferably carried out in the atmosphere using electron accelerators having an acceleration voltage of 150 to 400 kV with an output of 1 to 100 mA depending on the scanner width and the requisite material throughput. In vacuo, acceleration of the electrons to 20 – 60 kV suffices.

BRIEF DESCRIPTION OF THE DRAWING

The only FIGURE of the drawing is a side sectional view of the apparatus used for carrying out the process according to the invention.

Thus, the drawing shows schematically, in section, the scanner 1, the electron beam outlet window 2 and the window flange 5 of an electron accelerator. The electrons arriving under acceleration in the evacuated scanner 1 issue into the air through the electron beam outlet window 2 and act on the material 3 being irradiated. Material 3 being irradiated is moved by means of a conveying device 4 at right angles to the scanning direction and at right angles to the electron beam. The material being irradiated can be, for example, cold-rolled steel sheet, aluminum sheet, stainless steel sheet, galvanised (iron) sheet, tinplate and the like, covered with a very thin film of mineral oil for corrosion protection. Of course, these metal sheets can also be irradiated at atmospheric pressure under a gaseous organic substance, for example by blowing a hydrocarbon against the metal sheets at the irradiation station. It is also possible to carry out both the process variants described above in vacuo, for example by introducing the plane strip of metal sheet into a vacuum chamber through so-called pressure locks. In that case, electrons with an acceleration voltage of only 20 kV – 60 kV are required for the irradiation.

Figure 1:
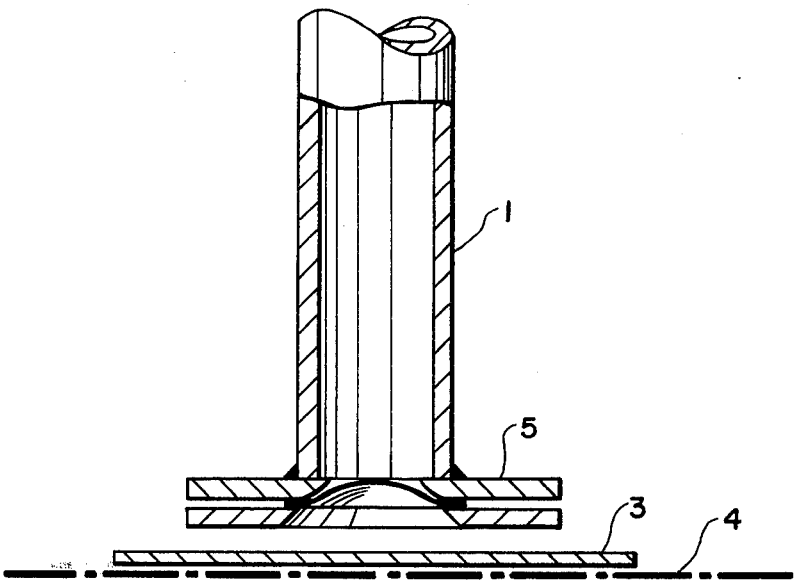

Organic compounds which can be used are, in particular, mineral oils and gaseous hydrocarbons. Of course, fatty oils, fats and waxes, as well as all liquid and gaseous derivatives of the aliphatic and aromatic hydrocarbons, including heterocyclic compounds, can also be used. As silicones it is in particular possible to use the oily silicones. It should be noted, however, as a fundamental principle, that according to the invention it is also possible to employ, instead of the organic and/or silicone compounds, such compounds of other elements as decompose under the influence of the high energy radiation to form a contamination layer on the metal surface which is to be coated.

As already mentioned, the coating of the metal surface which has been pre-treated according to the invention is carried out in the usual manner with plastic powders or plastic lacquer preparations. Preferably, an epoxide resin powder, especially having a particle size of approximately 12 to 50 $\mu$, is employed according to the invention.

Furthermore, it should be pointed out at this stage that according to the invention it has also been found, surprisingly, that the irradiation with high energy rays, especially with electron beams and/or ion beams, of steel surfaces which are coated with a thin film of an organic or silicone compound for temporary corrosion protection, results in lengthening the duration of the temporary corrosion protection. For example, 20 sample sheets were cut out of a cold-rolled (steel) sheet which is coated, by the sheet manufacturer, with a thin film of oil (deep drawing oil) to afford temporary corrosion protection. 10 of these "oiled" sample sheets were irradiated with electrons, whilst 10 were not. All 20 samples were then suspended for several weeks in a bath of tap water. The non-irradiated sample sheets had already rusted heavily after this period, while the irradiated sample sheets merely showed small patches of rust in isolated places. As a result of this treatment according to the invention, the temporary corrosion protection of "oiled" metal sheets can be extended from approx. 4 weeks to approx. 4 months.

The examples which follow serve to illustrate the invention without, however, restricting it thereto.

EXAMPLE 1

A cold-rolled steel sheet covered with a thin film of a deep-drawing oil is mechanically cleaned to remove dust and other contaminations, then bent to form a refrigerator cladding component, folded and then irradiated with electrons from an electron accelerator which has an acceleration voltage of 300 kV, an electron current of 50 mA and a scanner length of 1.30 m. The speed of advance of the bent and folded component which is to be irradiated is 6 m per minute. The electron accelerator, with scanner, is set up horizontal and the components are suspended and passed in front of the accelerator. The reach of the electrons in air is so great that even surfaces which run parallel to the electron beam receive a sufficient dose. Any areas which may lie in the shadow of the electron beam can also be irradiated, by fixing a lead reflector on which the electrons are reflected.

The epoxide resin powder is then applied electrostatically to the components pre-treated in this way and is sintered, and cured, in the course of 5 minutes at 200° C in a tunnel oven. The resulting coating shows excellent adhesion.

EXAMPLE 2

A continuous sheet of aluminum which is intended to be used for facade cladding is introduced through a pressure lock into a chamber which is under partial vacuum, and is irradiated with electrons. At the irradiation station, gaseous benzene is blown onto the metal sheet surface. Since flat sheet material is concerned, an electron accelerator with the following data is adequate: acceleration voltage 150 kV, electron beam current 100 mA, scanner length 1.30 m. The speed of travel of the aluminum sheet is 20 m per minute. The continuous aluminum sheet passes horizontally below the vertical electron accelerator. To irradiate the rear face (if this is also to be coated) it is possible to use a second electron accelerator with the same characteristic data.

The epoxide resin powder is applied electrostatically to the continuous metal sheet which has been pretreated in this way and is sintered, and cured, in the course of 5 minutes in a tunnel oven at 200° C. The resulting coating again shows excellent adhesion.

What we claim is:

1. Process for coating a metal surface with a synthetic resin which comprises irradiating the metal surface prior to the application of the synthetic resin with high energy rays consisting essentially of electrons in the presence of a composition containing at least one organic compound or at least one organosilicon-oxygen compound, and subsequently coating the metal surface with the synthetic resin, and wherein said composition comprises normally gaseous hydrocarbons.

2. Process for coating a metal surface with a synthetic resin according to claim 1 in which the metal surface is coated with synthetic resin powder having a particle size of from 12 to 50 $\mu$.

3. Process as claimed in claim 2, in which the synthetic resin is an epoxide resin.

4. Process for coating a metal surface with a synthetic resin which comprises irradiating the metal surface prior to the application of the synthetic resin with high energy rays consisting of electrons in the presence of a composition containing at least one organic compound or at least one organosilicon-oxygen compound, and subsequently coating the metal surface with synthetic resin, and wherein said composition comprises oily silicones.

5. Process according to claim 4, wherein the metal surface is coated with synthetic resin powder having a particle size of from 12 to 50 $\mu$.

6. Process as claimed in claim 5 in which the synthetic resin is an epoxide resin.

7. Process for coating a metal surface with a synthetic resin which comprises irradiating the metal surface prior to the application of the synthetic resin with high energy rays consisting of electrons in the presence of a composition containing at least one organic compound or at least one organosilicon-oxygen compound, and subsequently coating the metal surface with the synthetic resin, and in which the metal surface is kept substantially free from fat and oil, and the irradiation is carried out in the presence of at least one gaseous organic hydrocarbon compound.

8. Process according to claim 7, wherein the metal surface is coated with synthetic resin powder having a particle size of from 12 to 50 $\mu$.

9. Process as claimed in claim 8, in which the synthetic resin is an epoxide resin.

* * * * *